US009080414B2

(12) United States Patent
Watson et al.

(10) Patent No.: US 9,080,414 B2
(45) Date of Patent: Jul. 14, 2015

(54) METHOD OF TREATING A DOWNHOLE FORMATION USING A DOWNHOLE PACKER

(71) Applicants: Brock Watson, Oklahoma City, OK (US); Roger Schultz, Ninnekah, OK (US); Andy Ferguson, Moore, OK (US); Mark Britton, Carter, OK (US)

(72) Inventors: Brock Watson, Oklahoma City, OK (US); Roger Schultz, Ninnekah, OK (US); Andy Ferguson, Moore, OK (US); Mark Britton, Carter, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 14/050,792

(22) Filed: Oct. 10, 2013

(65) Prior Publication Data

US 2015/0101811 A1 Apr. 16, 2015

(51) Int. Cl.

| | |
|---|---|
| ***E21B 43/26*** | (2006.01) |
| ***E21B 33/12*** | (2006.01) |
| ***E21B 33/129*** | (2006.01) |
| ***E21B 43/114*** | (2006.01) |

(52) U.S. Cl.
CPC ..... *E21B 33/12* (2013.01); *E21B 33/1291* (2013.01); *E21B 43/114* (2013.01); *E21B 43/26* (2013.01)

(58) Field of Classification Search
USPC ..... 166/298, 308.1, 177.5, 55, 55.1, 55.2, 166/222, 223; 175/67, 313
See application file for complete search history.

(56) References Cited

U.S. PATENT DOCUMENTS

| | | | | |
|---|---|---|---|---|
| 2,173,903 | A * | 9/1939 | Halliburton | 277/340 |
| 3,273,645 | A * | 9/1966 | Der Mott | 166/55.1 |
| 2008/0066917 | A1* | 3/2008 | Lehr et al. | 166/308.1 |
| 2011/0198082 | A1* | 8/2011 | Stromquist et al. | 166/298 |

* cited by examiner

*Primary Examiner* — David Andrews
*Assistant Examiner* — Ronald Runyan
(74) *Attorney, Agent, or Firm* — Hall Estill Law Firm

(57) ABSTRACT

This disclosure is directed to a method of using a packer having at least two areas of relative rotation. The disclosure is further directed toward a method of using a packer incorporating a jet port, a highly debossed mandrel and/or a J-pin rotatably disposed within a drag block assembly for continuously and redundantly engaging a J-slot area disposed in the mandrel.

17 Claims, 6 Drawing Sheets

METHOD OF TREATING A DOWNHOLE FORMATION USING A DOWNHOLE PACKER

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE DISCLOSURE

1. Field of the Invention

The present disclosure relates to a packer constructed to operate repeatedly in very sandy conditions.

2. Description of the Related Art

Sand can be used in various perforating and fracturing operations, which can cause packers to seize or get stuck and not be operational in a wellbore. When packers become non-operational, or get stuck in the wellbore, various problems occur. One major problem is that the packer can no longer be used and no other zones in the wellbore can be perforated or fractured.

Accordingly, there is a need for a packer that is better equipped to stay operational when sand is present in the wellbore.

SUMMARY OF THE DISCLOSURE

The disclosure is directed toward a method of using a specially designed packer. The method includes running a packer downhole into a casing adjacent to a formation. Once the packer, which has two or more relative areas of rotation, is run down into the hole, the packer can be set in casing. The formation can also be abrasively perforated and the resulting perforations can be fractured.

The disclosure is further directed toward a method of using a specially designed packer. The method includes running a packer downhole into a casing adjacent to a formation. Once the packer, which has a mandrel having a plurality of debossed areas to reduce places where sand can accumulate and prevent operation of the packer and a plurality of holes disposed in the side of the mandrel, is run down into the hole, the packer can be set in casing. The formation can also be abrasively perforated and the resulting perforations can be fractured.

The disclosure is also directed toward a method of supplying fluid into an annular treating area via downhole piping during a fracturing operation. The method includes setting a packer at a predetermined location in a casing, the packer included in a bottom hole assembly. The method also includes the step of perforating a formation and fracturing the formation by supplying fracturing fluid in the casing and outside of the downhole piping. The method further includes pumping fluid through the downhole piping and out an opening disposed in a bottom hole assembly while the fracturing fluid is in the annular space.

DETAILED DESCRIPTION OF THE DISCLOSURE

The present disclosure relates to a packer 10 run down into casing 12 in a wellbore. The packer 10 is used to hydraulically isolate an upper area 14 in the casing 12 from a lower area 16 in the casing 12. The upper area 14 can include perforations that could be subject to high pressure fracturing operations and the lower area 16 can include fractures from earlier fracturing operations, where it is desirable to prevent additional fracturing via high pressure fracturing fluid. The packer 10 described herein is generally described as a packer used with coiled tubing but it should be understood that the packer 10 can be used with any type of downhole piping, such as coiled tubing, drill pipe, drill string, etc.

Figure 1:
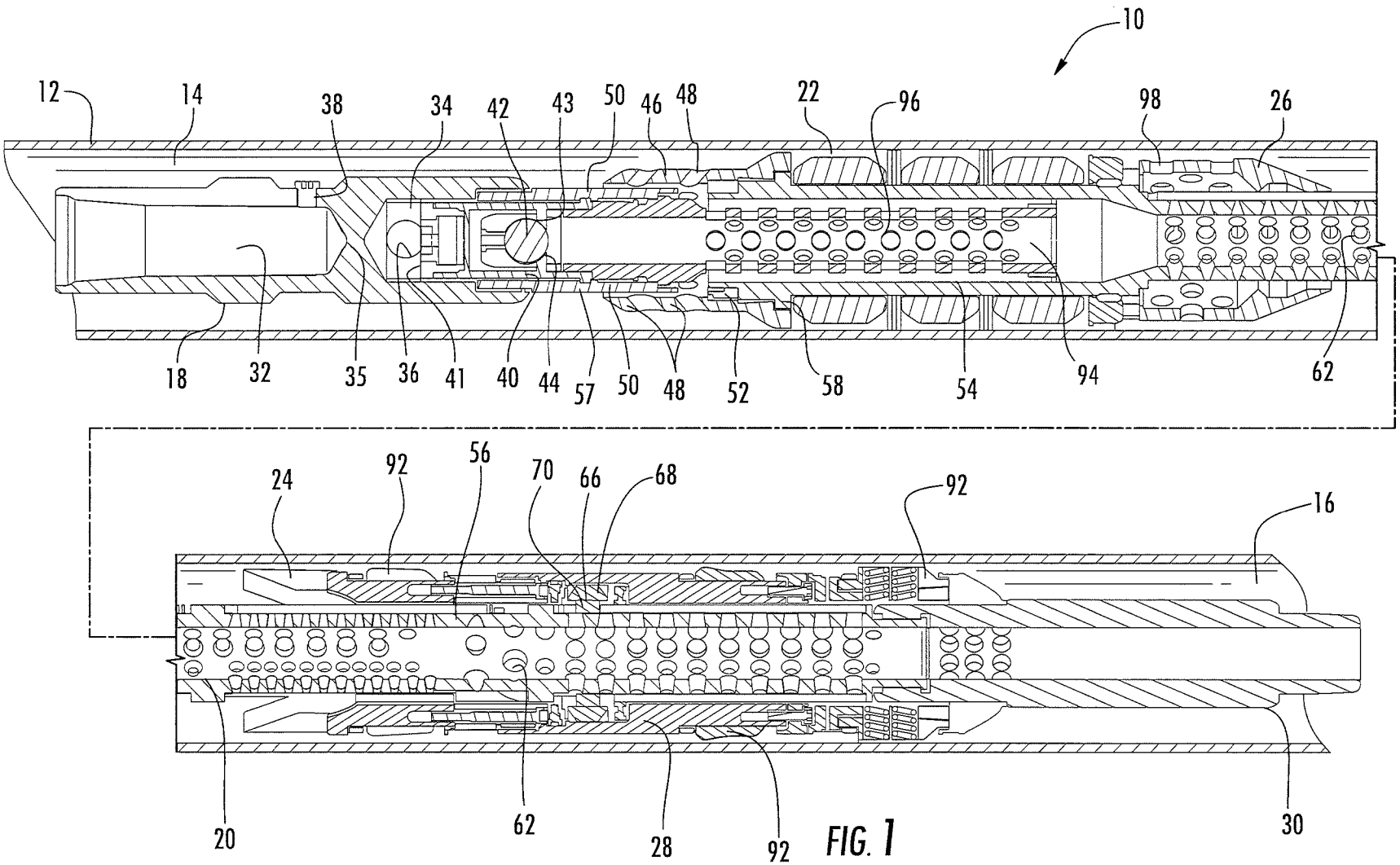
FIG. 1 is a cross-sectional view of a packer constructed in accordance with the present disclosure.
Figure 2:
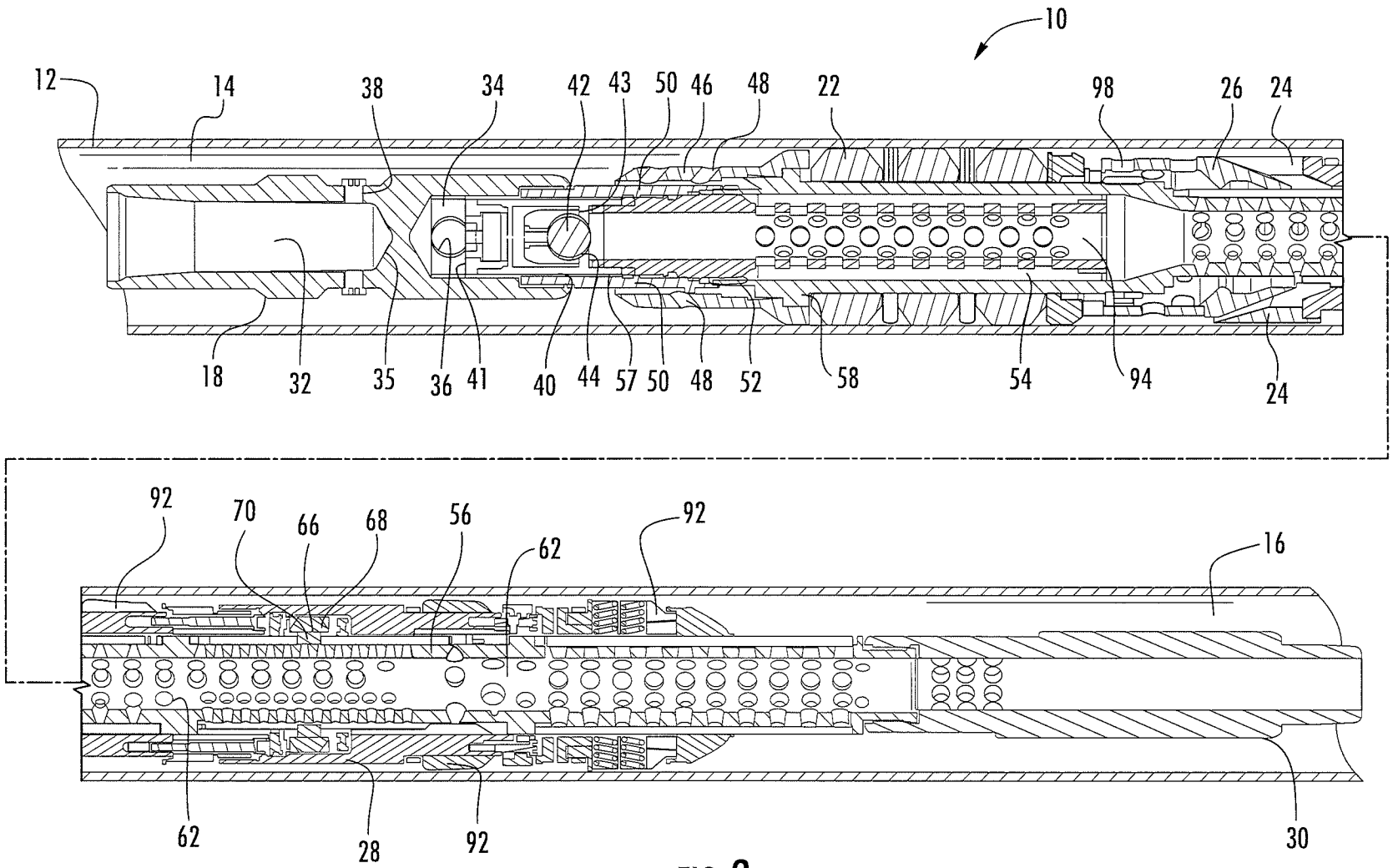
FIG. 2 is a cross-sectional view of the packer constructed in accordance with the present disclosure.
Figure 3A:
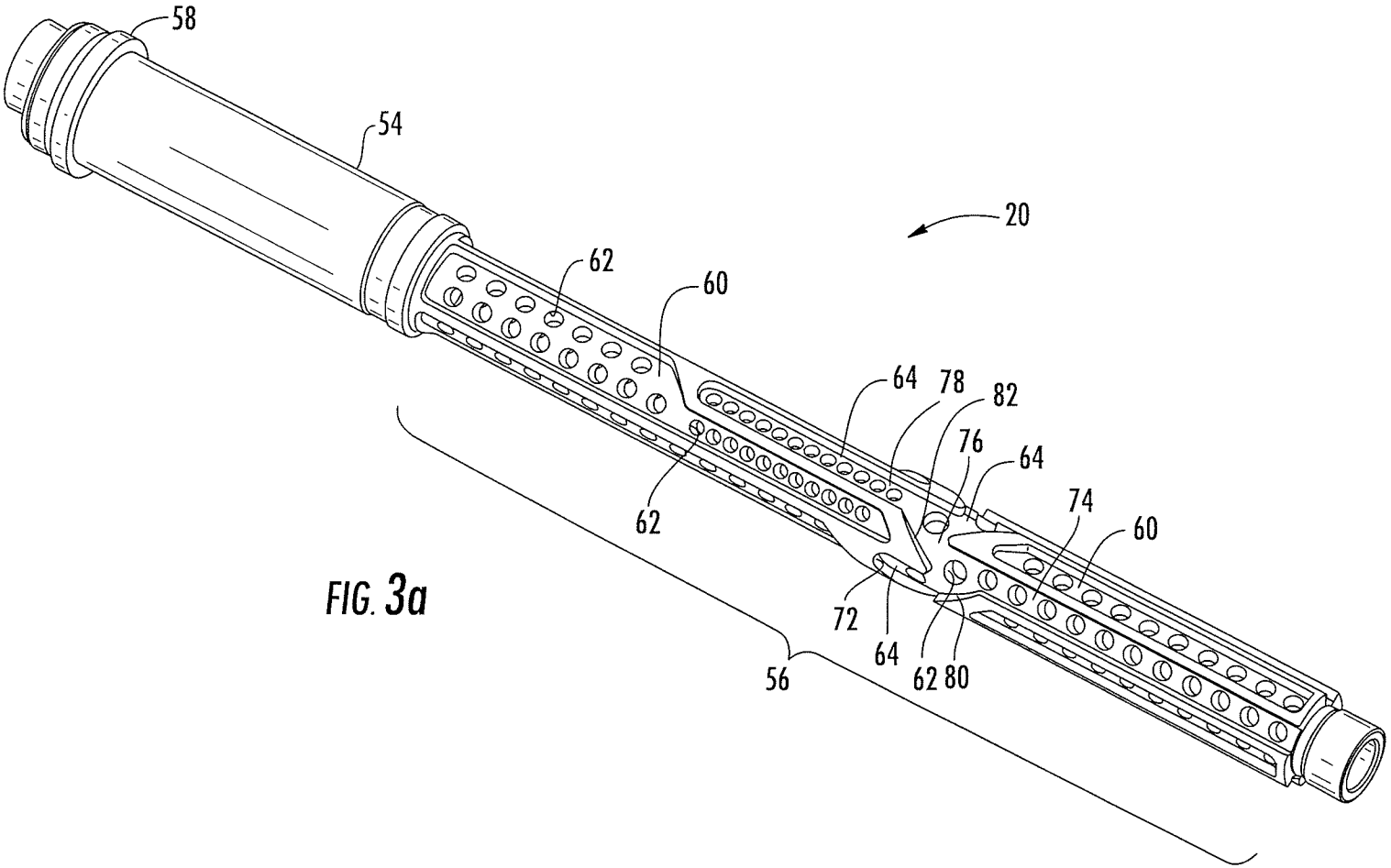
FIG. 3A is a perspective view of a mandrel of the packer constructed in accordance with the present disclosure.
Figure 3B:
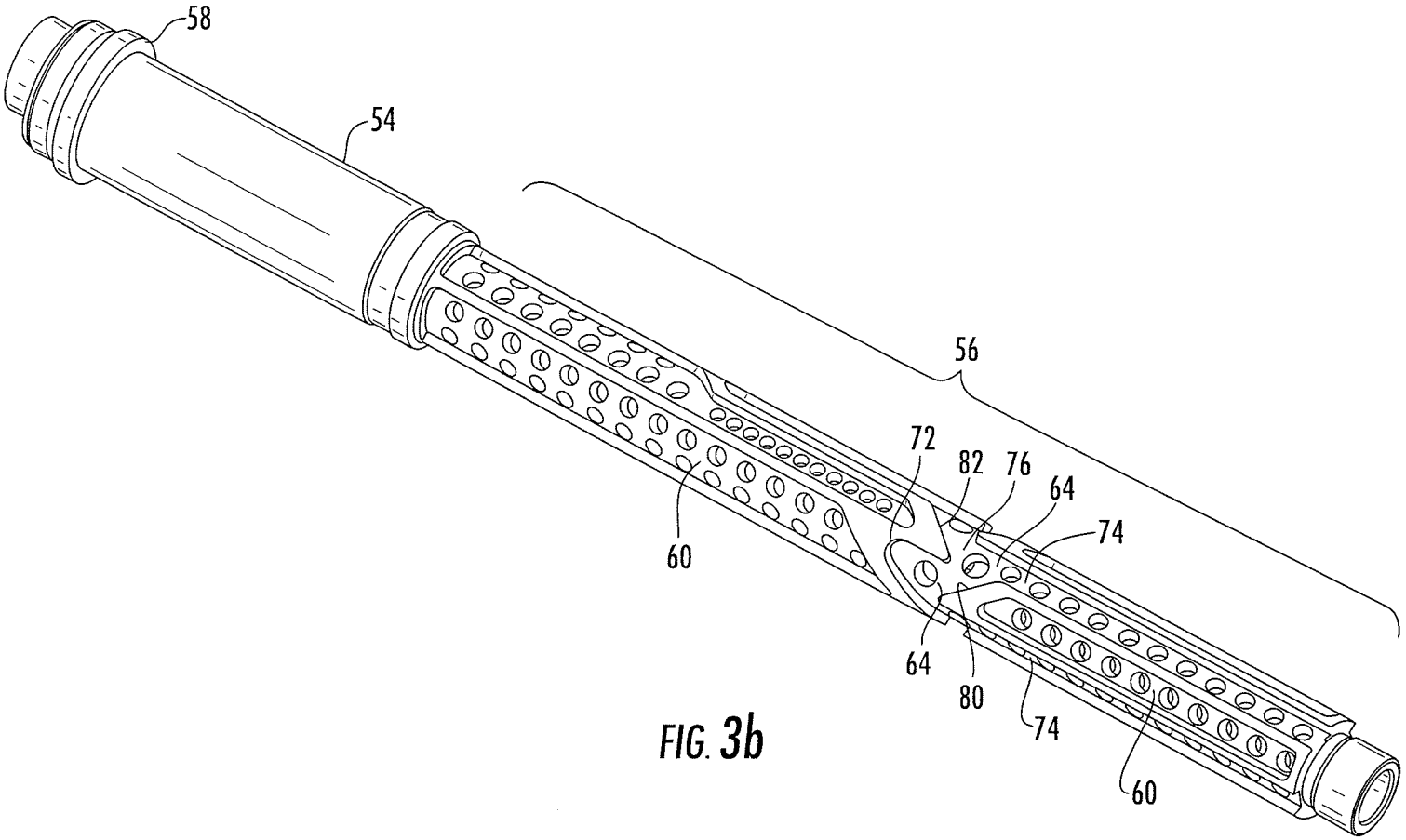
FIG. 3B is another perspective view of the mandrel of the packer constructed in accordance with the present disclosure.
Figure 3C:
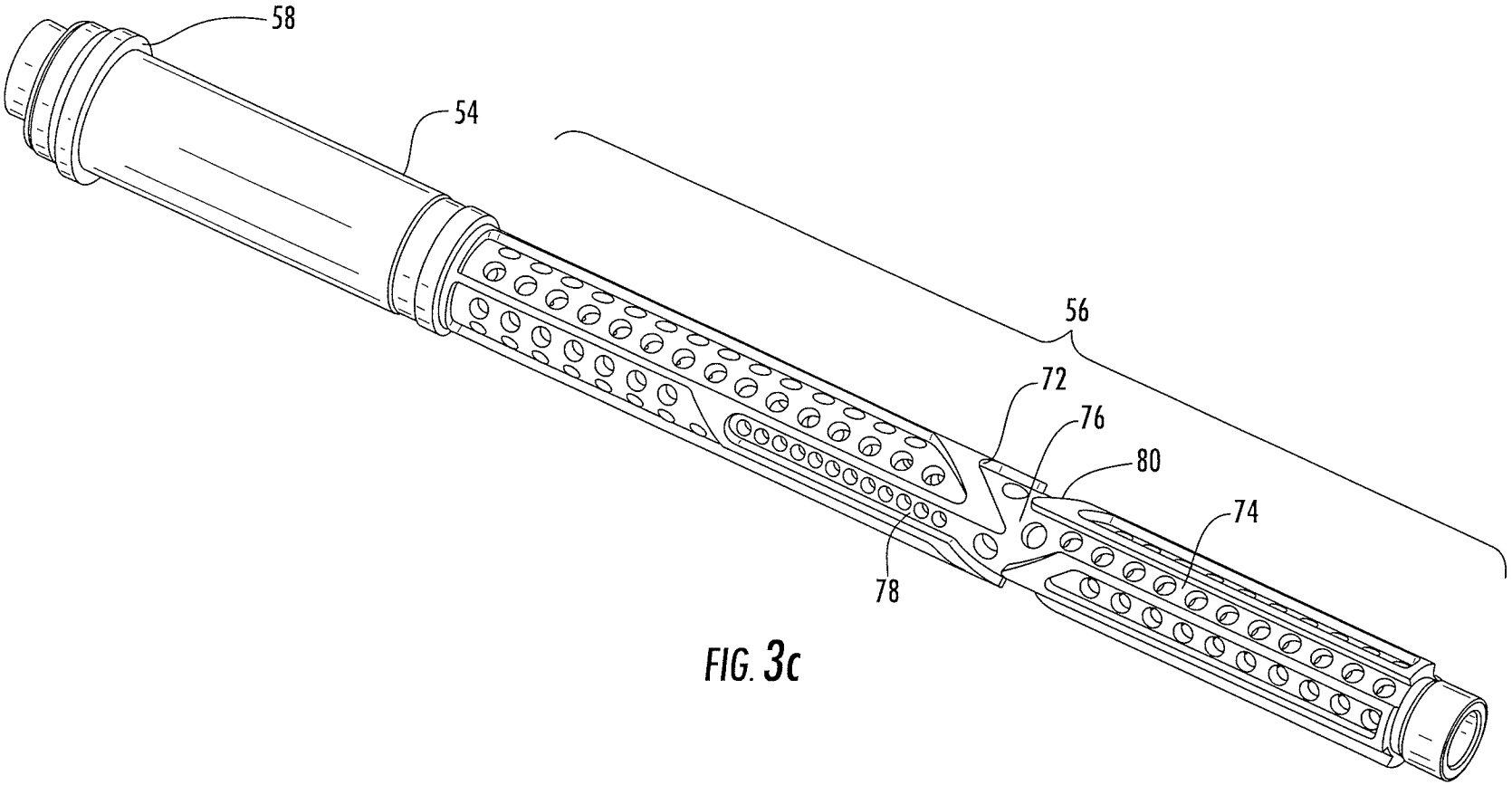
FIG. 3C is yet another perspective view of the mandrel of the packer constructed in accordance with the present disclosure.
Figure 3D:
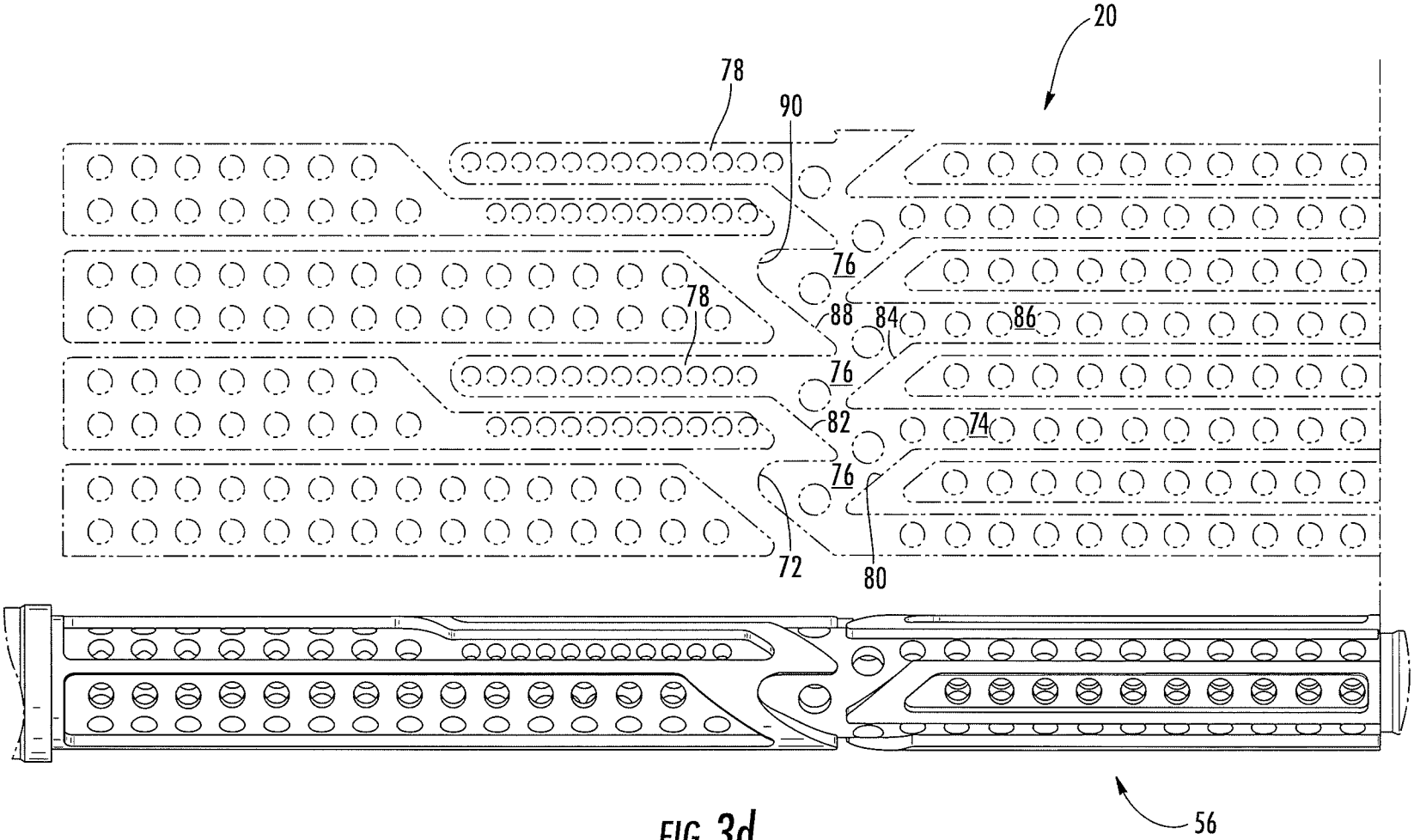
FIG. 3D is an engineering layout view of the mandrel of the packer constructed in accordance with the present disclosure.

Referring now to FIGS. 1 and 2, shown therein is the packer 10 in a first position (FIG. 1) and a second position (FIG. 2). In the first position, shown in FIG. 1, the packer 10 can be moved inside the casing 12 and disposed at a predetermined location/depth inside the casing 12. In the second position, shown in FIG. 2, the packer 10 is shown in a set position inside the casing 12. When the packer 10 is in the set position, the upper area 14 in the casing 12 is hydraulically isolated from the lower area 16 in the casing 12.

In the embodiment shown in FIG. 1, the packer 10 includes a top sub 18 for connecting the packer 10 to another downhole tool (e.g., abrasive perforator) or downhole piping, a mandrel 20 rotatably supported by the top sub 18, at least one packer element 22 disposed around a portion of the mandrel 20 for selectively engaging the casing 12 and providing the hydraulic isolation between the upper and lower areas 14 and 16, and at least one slip element 24 slidably and rotatably disposed around a portion of the mandrel 20 for selectively engaging the casing 12 and preventing the packer 10 from moving inside the casing 12 when the packer 10 is in the set position. The packer 10 further includes a wedge element 26 slidably disposed around a portion of the mandrel 20 for engaging the at least one slip element 24 to force the at least one slip element 24 toward the casing 12 when the packer 10 is moved into the second position, and a drag block assembly 28 slidably and rotatably disposed around a portion of the mandrel 20 for frictionally engaging the casing 12 to substantially maintain the position of the packer 10 in the casing 12 while the packer 10 is manipulated into the second position. The packer 10 can also include a lower sub 30 attached to the mandrel 20 for preventing the drag block assembly 28 from sliding off the mandrel 20 and for possible connection to other downhole tools.

The top sub 18 can include a first interior portion 32 that is in fluid communication with any tool or downhole piping disposed above the packer 10 and a second interior portion 34 in fluid communication with the mandrel 20. The first and second interior portions 32 and 34 of the top sub 18 are separated by a fluid blocking member 35 and are not in fluid communication with each other. The second interior portion 34 includes a port 36 disposed therein for permitting fluid in the lower area 16 to be forced into the upper area 14 of the casing 12, which is above the at least one packer element 22. When the packer 10 is in the second (or set) position, the at least one packer element 22 is engaged with the casing 12 and the area in the casing 12 above the at least one packer element 22 can accumulate sand and compromise the operational integrity of the packer 10. In one embodiment, the first interior portion 32 of the top sub 18 includes an opening 38 disposed therein to permit high pressure fluid to flow out and circulate through the opening 38 and around the area in the casing 12 above the at least one packer element 22. This flow also prevents sand from settling in that area, which can prevent the packer 10 from working properly. In another embodiment, the opening 38 can be a jet port or a nozzle for creating a turbulent flow of the fluid exiting the opening 38 to better prevent the sand from settling about the packer 10 above the at least one packer element 22. In yet another embodiment, the opening 38 can be a nozzle constructed and designed to be abrasive resistant so as to withstand abrasive fluids used in perforating and fracturing operations.

In another embodiment, the packer 10 includes a check valve 40 disposed in the packer 10, the check valve 40 having a top portion 41 in fluid communication with the upper area 14 above the at least one packer element 22 and a bottom portion 43 in fluid communication with the lower area 16 below the at least one packer element 22 in the casing 12. The check valve 40 also allows fluid to bypass the packer 10 while running the packer 10 into the casing 12. When the packer 10 is being set, or after the packer 10 is set, the check valve 40 permits fluid (gas or liquid) under pressure to pass through the mandrel 20 and the check valve 40 and exit the packer 10 via the port 36 of the top sub 18. The check valve 40 prevents a hydraulic force from forming in the lower area 16 in the casing below the packer 10 which can be greater than the available setting force from the downhole piping. In one exemplary embodiment, the check valve 40 can include a ball 42 and a seat 44 whereby the ball 42 is unseated from the seat 44 when the pressure below the packer 10 becomes greater than the pressure above the packer 10. Once the ball 42 is unseated, fluid below the packer 10 can pass through the port 36 and enter the upper area 14 in the casing 12.

In a further embodiment, the packer 10 includes an unloader valve 46 that permits fluid to flow through the packer 10 instead of only being able to flow around the outside of the packer 10 when the packer 10 is being run, moved or unset in the casing 12. The unloader valve 46 includes at least one passageway 48 disposed therein for allowing fluid to pass from an inside portion of the packer 10 to an outside portion of the packer 10 above the at least one packer element 22 via the at least one passageway 48 when the packer 10 is being run, moved or unset in the casing 12. Similarly, fluid is allowed to pass from the outside portion of the packer 10 above the at least one packer element 22 to the inside portion of the packer 10 via the at least one passageway 48. When the packer 10 is in the set position, blockage elements 50 of the unloader valve 46 engage a face seal 52 to prevent fluid from flowing through the unloader valve 46.

The mandrel 20 includes a first end 54 rotatably supported by the top sub 18 and a second end 56 disposed adjacent to the lower sub 30. In one embodiment, the mandrel 20 is rotatably connected to the top sub 18 via a ported housing 57. The first end 54 includes a lip 58 positioned adjacent to the at least one packer element 22 to prevent the at least one packer element 22 from sliding upward (i.e., in the uphole direction, even when the packer 10 is used in a horizontally disposed wellbore) when the packer 10 is moved into the set position. The at least one packer element 22 is disposed around the first end 54 of the mandrel 20 and adjacent to the lip 58. The wedge element 26 is disposed around the mandrel 20 on the opposite side of the at least one packer element 22. As the at least one slip element 24 engages the wedge element 26, the wedge element 26 is forced against the at least one packer element 22 which causes the expansion of the at least one packer element 22 into the casing 12. This hydraulically seals the upper area 14 in the casing 12 from the lower area 16 in the casing 12.

Referring now to FIGS. 3A-3D, shown therein is the mandrel 20 constructed in accordance with the description herein. The second end 56 of the mandrel 20 includes a plurality of debossed areas 60 that include a plurality of holes 62 disposed therein to allow for sand to pass through the packer 10 and not build up and prevent the operation of the packer 10. The debossed areas 60 also help prevent sand from causing the packer 10 to stick and become nonoperational. The second end 56 of the mandrel 20 also includes a J-slot area 64 for receiving and guiding a J-pin 66 rotatably disposed in the drag block assembly 28, which is disposed around the second end 56 of the mandrel 20. The J-slot area 64 is designed such that the J-pin 66 is permitted to redundantly move around the mandrel 20. In one embodiment, at least 50% of the cylindrical surface area of the mandrel 20 is comprised of the debossed areas 60 and/or the holes 62.

In one embodiment, the J-pin 66 includes a collar 68 rotatable disposed within the drag block assembly 28 and at least one extension element 70 disposed inside the collar 68 for being guided through the J-slot area 64. The J-slot area 64 includes at least one shoulder 72 for engaging the extension element 70 of the J-pin 66, at least one downward corridor 74 extending in a downhole direction from a central area 76 of the J-slot area 64, and at least one upward corridor 78 extending in an uphole direction from the central area 76 of the J-slot area 64. It should be understood and appreciated that as the extension element 70 of the J-pin 66 is guided in the various parts of the J-slot area 64 in the downhole and uphole directions, the drag block assembly 28 is also moved in the downhole and uphole direction via the extension element 70 of the J-pin 66.

When the extension element 70 of the J-pin 66 is engaging the at least one shoulder 72, the packer 10 is typically in the run in position (forced downward or downhole in the casing) which corresponds to the packer 10 being in the first position. When attempting to set the packer 10 in the casing 12, the J-pin 66 will generally need to be moved from the at least one shoulder 72 to the at least one upward corridor 78. This is accomplished by lifting up on the packer 10 which permits the at least one extension element 70 of the J-pin 66 to disengage the at least one shoulder 72 and contact a first ridge 80 positioned beneath the at least one shoulder 72 (in a downhole direction) and angled downwardly to force the extension element 70 of the J-pin 66 ultimately into the downward corridor 74. Once the extension element 70 of the J-pin 66 is in the downward corridor 74, weight is then placed back onto the packer 10 which forces the extension element 70 of the J-pin 66 upward and out of the downward corridor 74 into a second ridge 82 positioned above the downward corridor 74 (in an uphole direction) and angled upwardly to force the extension element 70 of the J-pin 66 through the central area 76 of the J-slot area 64 and ultimately into the upward corridor 78.

As the extension element 70 of the J-pin 66 travels up the upward corridor 78, the drag block assembly 28 and the at least one slip element 24 are forced towards the wedge element 26. Eventually, the at least one slip element 24 is forced to engage the wedge element 26. In addition to squeezing the at least one packer element 22 and hydraulically sealing the casing 12 as described herein, the at least one slip element 24 is forced outward and into the casing 12 until the at least one slip element 24 is engaged with the casing 12 such that the packer 10 will not move in the casing 12 up to predetermined hydraulic pressures. Once the at least one slip element 24 and the at least one packer element 22 are fully engaged with the casing 12, the packer 10 is in the set position (or second position shown in FIG. 2). The at least one slip element 24 can be any type of slip element known in the art. The slip element 24 can include buttons, wickers, or a combination thereof.

After the packer 10 has been set and it is desirable for the packer 10 to be unset and moved in the casing 12, upward force can be applied to the packer 10. The upward force causes the wedge element 26 to disengage from the at least one slip element 24, which permits the at least one slip element 24 and the drag block assembly 28 to move away from the wedge element 26 and allows the wedge element 26 to stop squeezing the at least one packer element 22. The at least one packer element 22 will no longer hydraulically seal the upper area 14 in the casing 12 from the lower area 16 in the casing 12. Additionally, the at least one slip element 24 will disengage from the casing 12 and permit the packer 10 to again be moved in the casing 12.

Once the at least one slip element 24 is disengaged from the wedge element 26, the drag block assembly 28 and the J-pin 66 (and the extension element 70 of the J-pin 66) rotatably disposed therein can now move in the downhole direction in the upward corridor 78. The extension element 70 of the J-pin 66 then exits the upward corridor 78 and crosses the central area 76 of the J-slot area 64 and contacts a third ridge 84 positioned beneath the upward corridor 78 (in a downhole direction) and angled downwardly to force the extension element 70 of the J-pin 66 ultimately into a second downward corridor 86. The upward force applied to the packer 10 causes the drag block assembly 28 (and thus the extension element 70 of the J-pin 66) to travel in the downhole direction. The drag block assembly 28 is prevented from coming off the mandrel 20 by the lower sub 30.

The packer 10 is now back in the first position (or run position) and can now be moved uphole in the casing 12 and moved to another location and reset. The packer 10 can also be moved back in the downhole direction in the casing 12 if desired. In this scenario, the extension element 70 of the J-pin 66 will travel in the uphole direction in and out of the second downward corridor 86 and across the central area 76 of the J-slot area 64. Once across the central area 76 of the J-slot area 64, the extension element 70 of the J-pin 66 will contact a fourth ridge 88 positioned above the second downward corridor 86 (in an uphole direction) and angled upwardly to force the extension element 70 of the J-pin 66 ultimately into a second shoulder 90.

In another embodiment, the mandrel 20 includes two shoulders 72 disposed on opposite sides of the mandrel 20 from each other, two upward corridors 78 disposed 90° from the shoulders 72 and on opposite sides of the mandrel 20 from each other, and four downward corridors 74. In a further embodiment, the collar 68 of the J-pin 66 includes two extension elements 70. In this embodiment, the two extension elements 70 engage the shoulders 72 at the same time, then engage two of the four downward corridors 74 and then the two extension elements 70 will engage the two upward corridors 78 at the same time. The two extension elements 70 can then engage the other two downward corridors 74 followed by the extension elements 70 then engaging the shoulders 72 again. The J-pin 66 can continuously maneuver around the mandrel 20 as depicted herein.

The drag block assembly 28 can include at least one drag block 92 for frictionally engaging the casing 12. The packer 10 can also include at least one sleeve 94 with a plurality of perforations 96 disposed therein. Similar to the holes 62 disposed in the mandrel 20, the perforations eliminate stagnant areas that are prone to collecting sand. The perforations 96 and holes 62 permit the packer 10 to be cleaned from accumulated sand as the packer 10 is moved up and down in the casing 12. The wedge element 26 can also include openings 98 disposed therein to provide the same functions as the perforations 96 and the holes 62.

For the packer 10 to remain operational, the J-pin 66 has to be able to rotate around and slide uphole and downhole on the mandrel 20. Relative rotation areas on the packer 10 are important because the packer 10 is ultimately connected to downhole piping (not shown) which does not rotate like a drill pipe can. The more areas of relative rotation allows the J-pin 66 to have more ways to be able to move about the J-slot area 64 of the packer 10 and allow the packer 10 to move from the first position to the second position and back to the first position. In one embodiment of the present disclosure, the packer 10 has at least two relative rotational areas. One area of relative rotation of the packer 10 is between the downhole piping (not shown) or the top sub 18 and the mandrel 20. Another area of relative rotation for the packer 10 is between the drag block assembly 28 and the mandrel 20. A third area of relative rotation for the packer 10 is between the J-pin 66 and the drag block assembly 28. It should be understood that the areas of relative rotation are capable of 360° rotation.

The present disclosure is also directed to a method of using the packer 10 in downhole operations such as perforating and fracturing operations conducted on downhole formations. The packer 10 can be run down into the casing 12 as an inclusion of a bottom hole assembly (BHA). In one embodiment, the packer 10 can be run down into the casing 12 with the BHA and set at a predetermined depth/location. The formation can then be abrasively perforated after the packer 10 is set. Once the abrasive perforation operation is concluded, the formation can then be subjected to a fracturing operation. In another embodiment of the present disclosure, the formation can be abrasively perforated prior to setting the packer 10.

In another embodiment, the packer 10 (and the BHA the packer 10 is incorporated into) can be unset and moved to a second location in the casing 12 without being removed from the casing 12. The packer 10 can then be reset at the second location. Once the packer 10 is set at the second location, the formation can be abrasively perforated to create additional perforations in the formation. Another fracturing operation may be implemented to fracture the perforations generated at the second location. It should be understood that the abrasive perforating could be done prior to setting the packer at the second location. Additionally, it should be understood and appreciated that the methods disclosed herein can be repeated at numerous locations in the casing 12.

The disclosure herein is also related to a method for circulating fluid in the upper area 14 in the casing 12 and a method for monitoring annular treating pressure via the downhole piping. The annular treating pressure can be the pressure of the fluid used during fracturing operations which is provided down into the casing 12 outside of the downhole piping and any components of the BHA disposed above the at least one packer element 22. More specifically, the annular treating pressure can be the pressure of the fracturing fluid in the area substantially adjacent to where the perforations in the formation were created via a perforation operation.

In one embodiment, a relatively low flow of fluid is pumped into the downhole piping during a fracturing operation. The fluid is pumped at a low flow rate so that the fluid will experience very little frictional pressure drop through the downhole piping. The low flow rate can be any flow rate less than about 0.5 barrels per minute. When the frictional pressure drop is low across the downhole piping, BHA and/or any particular component of any tool in the BHA, the pressure required to pump the fluid into and through the downhole piping, BHA and/or components of tools in the BHA can provide a fairly accurate measurement of the annular treating pressure at a desired location in the casing 12. The annular treating pressure is approximately the sum of the surface treating pressure (or surface injection pressure) and the calculated hydrostatic pressure (based on vertical depth) at a predetermined location/depth inside the downhole piping or the BHA.

In one exemplary embodiment, the components of tools in the BHA that fluid can be pumped through when measuring the annular treating pressure can include, but are not limited to, the opening 38 in the packer 10 and a nozzle in an abrasive perforator that may be included in the BHA.

In yet another embodiment, a fluid can be pumped through the downhole piping and out the opening 38 in the packer 10 during fracturing operations to circulate fluid in the upper area 14 in the casing 12 above the at least one packer element 22. This fluid circulation stirs and flushes proppants in the fracturing fluid, such as sand, away from the top of the packer 10 to prevent the sand from accumulating on and/or around the packer 10. Accumulation of sand atop and/or around the packer 10 can prevent the unsetting and subsequent resetting of the packer 10. For this embodiment, the fluid can be pumped through the downhole piping at a low flow rate and the annular treating pressure can be measured while circulating fluid to flush the sand. The fluid can also be pumped through the downhole piping at higher flow rates to better ensure the sand is stirred and flushed from atop and/or around the packer 10.

From the above description, it is clear that the present disclosure is well adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A method, the method comprising:

running a packer downhole into a casing adjacent to a formation, the packer comprising:

a packer supported by downhole piping, the packer having a mandrel, a top sub for connecting the packer to other downhole tools and three or more areas of relative rotation between components of the packer wherein one area of relative rotation exists between the top sub and the mandrel;

setting the packer in the casing;

abrasively perforating the formation to create perforations therein; and fracturing the perforations in the formation.

2. The method of claim 1 wherein the step of setting the packer in the casing is done before or after the step of abrasively perforating the formation to create perforations therein.

3. The method of claim 2 further comprising the steps of:

unsetting the packer in the casing;

moving the packer to a plurality of locations in the casing without removing the packer from the casing;

resetting the packer at each location the packer is moved to in the casing;

abrasively perforating the formation at each location to create additional perforations therein; and fracturing the additional perforations in the formation at each location.

4. The method of claim 1 wherein the packer further comprises:

at least one packer element disposed around a portion of the mandrel for hydraulically sealing an upper area in a casing from a lower area in the casing;

a wedge element disposed around a portion of the mandrel adjacent to the at least one packer element;

at least one slip element disposed around the mandrel adjacent to the wedge element; and a drag block assembly disposed around a portion of the mandrel to frictionally engage the casing.

5. The method of claim 4 wherein the packer further comprises a jet port disposed therein above the at least one packer element to circulate fluid outside the packer and above the at least one packer element to prevent sand accumulation during fracturing and perforating operations when the packer is in a set position, the jet port in fluid communication with the downhole piping.

6. The method of claim 5 wherein the jet port is disposed in a top sub of the packer, the top sub having a first interior portion in fluid communication with the downhole piping, a second interior portion in fluid communication with an area in the casing below the at least one packer, and a fluid blocking member disposed therebetween.

7. The method of claim 4 wherein the downhole piping is coiled tubing.

8. The method of claim 1 wherein one of the areas of relative rotation for the packer drag block assembly rotation relative to the mandrel.

9. The method of claim 1 wherein the packer further comprises a J-pin rotatably disposed within the drag block assembly.

10. The method of claim 9 wherein the third area of relative rotation is the J-pin rotation relative to the drag block assembly.

11. The method of claim 1 wherein the packer further comprises a check valve to permit pressurized fluid to flow from below at least one packer element of the packer to above the at least one packer element when pressure of fluid below the at least one packer element gets a predetermined amount higher than the pressure of fluid above the at least one packer element.

12. The method of claim 11 wherein the check valve is a ball check valve and the packer has a hole disposed therein for permitting fluid passing through the check valve to exit the packer.

13. The method of claim 1 wherein each area of relative rotation can be 360° in at least one direction.

14. A method, the method comprising:

running a packer downhole into a casing adjacent to a formation, the packer comprising:

a mandrel having a plurality of debossed areas in addition to a J-slot area to reduce places where sand can accumulate and prevent operation of the packer and a plurality of constantly open holes disposed in the side of the mandrel outside of the J-slot area to provide constant fluid communication between an inner portion of the mandrel and an annular space between the mandrel and the casing;

setting the packer in the casing;

abrasively perforating the formation to create perforations therein; and fracturing the perforations in the formation.

15. The method of claim 14 wherein the step of setting the packer in the casing is done before or after the step of abrasively perforating the formation to create perforations therein.

16. The method of claim 15 further comprising the steps of:

unsetting the packer in the casing;

moving the packer to a plurality of locations in the casing without removing the packer from the casing;

resetting the packer at each location the packer is moved to in the casing;

abrasively perforating the formation at each location to create additional perforations therein; and fracturing the additional perforations in the formation at each location.

17. The method of claim 16 wherein at least 50 percent of the mandrel's cylindrical surface area is debossed.

* * * * *